US009067184B2

(12) United States Patent
Stewart

(10) Patent No.: US 9,067,184 B2
(45) Date of Patent: Jun. 30, 2015

(54) DISPENSING TUBE MIXING METHOD AND APPARATUS

(75) Inventor: Roderick Milton Stewart, Port Hope (CA)

(73) Assignee: HISTORIC PLASTER CONSERVATION PRODUCTS LIMITED, Port Hope (CA)

( * ) Notice: Subject to any disclaimer, the term of this patent is extended or adjusted under 35 U.S.C. 154(b) by 601 days.

(21) Appl. No.: 13/372,174

(22) Filed: Feb. 13, 2012

(65) Prior Publication Data

US 2012/0206992 A1 Aug. 16, 2012

Related U.S. Application Data

(60) Provisional application No. 61/442,434, filed on Feb. 14, 2011.

(51) Int. Cl.

| | |
|---|---|
| ***B01F 13/00*** | (2006.01) |
| ***B01F 7/00*** | (2006.01) |
| ***B01F 15/00*** | (2006.01) |
| ***B01F 15/02*** | (2006.01) |
| ***B28C 5/00*** | (2006.01) |
| ***B28C 5/10*** | (2006.01) |
| ***B28C 7/04*** | (2006.01) |

(52) U.S. Cl.

CPC ..... *B01F 13/0023* (2013.01); *B01F 7/00058* (2013.01); *B01F 7/00291* (2013.01); *B01F 15/0087* (2013.01); *B01F 15/0206* (2013.01); *B01F 15/0279* (2013.01); *B01F 2215/0047* (2013.01); *B28C 5/003* (2013.01); *B28C 5/10* (2013.01); *B28C 7/0463* (2013.01)

(58) Field of Classification Search

CPC ..... B01F 13/0023

USPC ..... 366/189, 194, 308; 206/220, 222

See application file for complete search history.

(56) References Cited

U.S. PATENT DOCUMENTS

| | | | | | |
|---|---|---|---|---|---|
| 364,059 | A | * | 5/1887 | Stauffert | 366/285 |
| 2,831,606 | A | * | 4/1958 | Alters | 222/1 |
| 3,195,778 | A | * | 7/1965 | Coates | 222/80 |
| 3,197,067 | A | * | 7/1965 | Rataczak | 222/130 |
| 3,766,917 | A | * | 10/1973 | Wimmer | 604/88 |

(Continued)

OTHER PUBLICATIONS

Phillips, Morgan W., "Adhesives for the Reattachment of Loose Plaster," Bulletin of the Association for Preservation Technology, 1980, pp. 37-63, vol. XII, No. 2.

*Primary Examiner* — David Sorkin

(74) *Attorney, Agent, or Firm* — Hanley, Flight & Zimmerman, LLC

(57) ABSTRACT

A container and dispensing method for mixing and dispensing a set of ingredients. The container includes a tube having a dispensing end and a filling end, the filling end being sealed by a first plunger. The container includes a second plunger between the dispensing end and the first plunger that separate the interior into a first cavity and a second cavity, each cavity holding at least one ingredient. The second plunger includes a breakable membrane portion. A mixing apparatus is inserted through the dispensing end, pierces the membrane portion, and urges the second plunger towards the first plunger, causing the ingredients between the plungers to flow through the pierced membrane portion and combine. The mixing apparatus feature expandable flanges, and may be driven with a rotating force to mix the combined ingredients within the tube. The first plunger is then used to dispense the mixture through the dispensing end.

11 Claims, 2 Drawing Sheets

(56) References Cited

U.S. PATENT DOCUMENTS 3,858,853 A * 1/1975 Rausch et al. ..... 366/279
4,371,094 A * 2/1983 Hutter, III ..... 222/1
4,580,682 A * 4/1986 Gorski et al. ..... 206/569
4,735,509 A * 4/1988 Rausch ..... 366/333
5,273,190 A * 12/1993 Lund ..... 222/83

* cited by examiner

DISPENSING TUBE MIXING METHOD AND APPARATUS

CROSS-REFERENCE TO RELATED APPLICATIONS

The present application claims priority to U.S. patent application Ser. No. 61/442,434 filed Feb. 14, 2011, and owned in common herewith. The contents of application 61/442,434 are hereby incorporated by reference.

FIELD

The present application generally relates to a dispensing device for dispensing caulk or grout and the like and, in particular, to a method and apparatus for mixing ingredients within the dispensing device.

BACKGROUND

Many mixtures of caulking, grout, mortar or similar substances need to be mixed immediately prior to use. In some cases, the mixture hardens on exposure to air. In some cases, the mixture may lose its elasticity or its pseudo-plastic characteristics. In some cases, the material 'flattens out' or loses volume due to escape of gases generated by effervescence of the mixed material.

For example, if the end product is grout, a fresh mixture, immediately deposited, will resist shrinkage. The fresh mixture is slightly effervescent. If grout is mixed ahead of time, and then stored, the resulting mixture loses its effervescence over time, and then shrinks upon drying.

The need to mix materials immediately prior to use can result in inaccurate on-site measurement of constituent ingredients for the mixture, and hand-mixing of the ingredients in a bucket or the like can result in lumps of unmixed material clogging the nozzle of a caulking gun. Loading the mixture from a bucket into a bulk loading caulking gun can be a gritty, messy task, and the gun requires a thorough cleaning afterwards.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
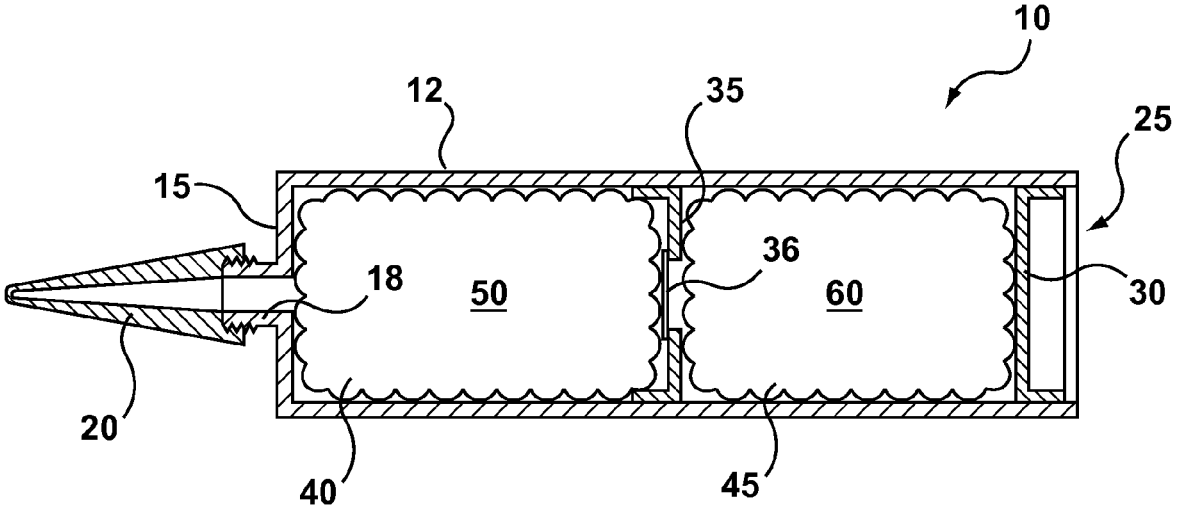
FIG. 1 shows an axial-section view of an example of a container for holding at least two ingredients.

The present application describes, in one aspect, a container and dispensing method for mixing and dispensing a set of ingredients. The container includes a tube having a dispensing end and a filling end, the filling end being sealed by a first plunger. The container includes a second plunger between the dispensing end and the first plunger that separate the interior into a first cavity and a second cavity, each cavity holding at least one ingredient. The second plunger includes a breakable membrane portion. A mixing apparatus is inserted through the dispensing end, pierces the membrane portion, and urges the second plunger towards the first plunger, causing the ingredients between the plungers to flow through the pierced membrane portion and combine. The mixing apparatus feature expandable flanges, and may be driven with a rotating force to mix the combined ingredients within the tube. The first plunger is then used to dispense the mixture through the dispensing end.

In a further aspect, the present application describes a container configured for mixing and dispensing a mixture of ingredients, the mixture comprising at least a first and second ingredient. The container includes a tube having a filling end and closed dispensing end, the closed dispensing end including an aperture through which the mixture of ingredients is dispensed, in use; a first plunger in the tube sealing the filling end; and a second plunger in the tube between the dispensing end and the first plunger, the second plunger including a breakable membrane portion. A first cavity is defined between the dispensing end and the second plunger for holding the first ingredient, and a second cavity is defined between the first plunger and the second plunger for holding the second ingredient.

In another aspect, the present application provides a dispensing device for dispensing a mixture of ingredients. The dispensing device includes a tube having a filling end and closed dispensing end, the closed dispensing end including an aperture through which the mixture of ingredients is dispensed, in use; a first plunger in the tube sealing the filling end; a second plunger in the tube between the dispensing end and the first plunger, the second plunger including a breakable membrane portion; and a mixing apparatus. The mixing apparatus includes an elongate shaft having a pointed end and a driving end, and a foldable set of flanges configured to be attached to the pointed end of the shaft. A first cavity is defined between the dispensing end and the second plunger for holding the first ingredient, and a second cavity is defined between the first plunger and the second plunger for holding the second ingredient. The foldable set of flanges has a width less than the diameter of the aperture when in a folded position, and they are biased in an unfolded position. The pointed end of the shaft is configured to pierce the breakable membrane when the mixing apparatus is inserted into the tube through the aperture.

In yet another aspect, the present application provides a device for dispensing a mixture from a dispensing tube, the mixture includes a first and second ingredient; the device includes: a) a cartridge having an inner moveable partition; the partition defining: i) a first cavity for holding the first ingredient, and ii) a second cavity for holding the second ingredient; the first cavity being proximal to a dispensing orifice of the cartridge, and a second cavity being proximal to a filling end of the cartridge; and b) a mixing apparatus; wherein the mixing apparatus: i) is inserted into the dispensing orifice; ii) pierces the moveable partition, iii) moves the moveable partition to the filling end of the caulking tube; and iv) mixes the two ingredients in the first cavity. Each ingredient can independently consist of a single substance, a mixture, or composition In yet a further aspect, the present application describes a method for dispensing a mixture from a dispensing tube, the mixture includes a first and second ingredient; the method includes the steps of: a) placing the first ingredient of the first cavity proximal a dispensing orifice of a cartridge; placing a second ingredient in a cavity proximal to a filling end of the cartridge; the first and second cavities defined by a moveable inner partition placed within the cartridge; b) mixing the first and second ingredients by: i) inserting a mixing apparatus into the dispensing orifice; ii) piercing the moveable partition; iii) moving the moveable partition to the filling end of the caulking tube; and iv) mixing the two ingredients in the first cavity; and c) dispensing the mixture through the dispensing orifice by use of cartridge with a caulking gun.

Other aspects and features of the present application will be understood by those of ordinary skill in the art from a review of the following description of examples in conjunction with the accompanying figures.

In the description that follows, wherever ranges of values are referenced within this specification, sub-ranges therein are intended to be included unless otherwise indicated. Where characteristics are attributed to one or another variant, unless otherwise indicated, such characteristics are intended to apply to all other variants, where such characteristics are appropriate or compatible with such other variants.

The present device allows for production of a fresh, effervescent mixture which can then be immediately applied, resulting in application of shrink-resistance grout.

Reference is first made to FIG. 1, which shows a longitudinal axial-sectional view of one example of a dispensing device 10. In one example embodiment, the dispensing device 10 includes a tube 12 having a dispensing end 15 and a filling end 25. In one example, the tube 12 may be a 30 oz/800 ml post Industrial High Density Polyethylene cartridge. In other examples, any size or make of cartridge can be used. Typical cartridges includes those commonly used for caulking and other such materials extruded from a nozzle. The dispensing end 15 of the tube 12 includes an aperture, which may include a threaded collar 18 for attachment to a threaded nipple 20, such an NPT nipple. In use, the threaded nipple 20 is cut off at the tip to provide an opening with a required diameter. In some other implementations, the nipple 20 may be attached to the collar 18 using other attachment mechanisms. In one implementation, the nipple 20 is integrally formed with the tube 12. In some embodiments, the nipple 20 may feature a pre-cut end and a screw on cap (not shown) for sealing the nipple 20.

The filling end 25 of the tube 12 includes a first plunger 30 that is put in place after the tube 12 is filled with its contents. Air may be evacuated from the compartment using standard industry methods. In use, the tube 12 is loaded into a caulking gun or similar apparatus and the first plunger 30 is steadily pushed by a mechanism of the caulking gun, thereby pushing the contents of the tube 12 towards the nipple 20, and extruding the contents from the cut open end of the nipple 20.

In this example embodiment, a second plunger 35 is inserted in the tube 12 during a filling operation. The second plunger 35 provides a barrier to separate a first set of ingredients 50 from a second set of ingredients 60. The second plunger 35 includes a breakable membrane portion 36 that may be pierced to permit mixing of the two sets of ingredients 50, 60. The mixture of the two ingredients provides for the final mixture or product to be extruded from the nipple 20. The exact location of the second plunger 35 within the tube 12 depends on the ratio of the two ingredients 50, 60 in the final mix. The second plunger 35 divides the interior of the tube 12 into two cavities 40, 45.

Each cavity 40, 45 contains one of the sets of ingredients 50, 60, respectively, separated by the second plunger 35. At least one of the sets of ingredients is wet. In this example the second set of ingredients 60 are wet ingredients that start curing once exposed to air. Therefore, the first and second plungers 30, 35 serve to prevent exposure of the second set of ingredients 60 to air until use. The first set of ingredients 50 is not solely air, and may be either dry or wet depending on the formulation of the mixture.

Figure 2:
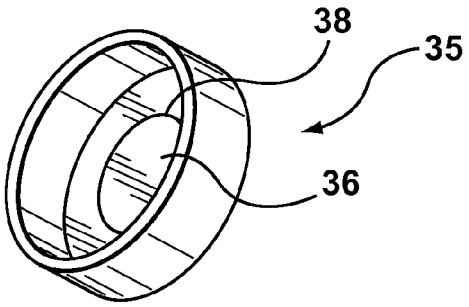
FIG. 2 shows a perspective view of an example second plunger.

Reference is now also made to FIG. 2, which shows an embodiment of the second plunger 35 in perspective view. In this embodiment, the second plunger 35 defines an axial aperture 38 that is sealed or covered by a membrane 36. The membrane 36 may include foil or thin plastic. The membrane 36 may be formed from any material that may be securely attached to the second plunger 35 to provide an airtight seal of the aperture 38 provided the material may be pierced, as will be described below.

The membrane 36 may be waterproof. The membrane 36 may be affixed to the second plunger 35 by affixing process, such as, but not exclusively, an adhesive. As an example, the membrane 36 may be formed using waterproof adhesive metal foil.

Referring still to FIG. 1, the second plunger 35 has an orientation opposite to that of the first plunger 30. The second plunger 35 is configured to be readily pushed from the direction of the collar 18 towards the first plunger 30, as a first operation in the mixing process.

When being filled, the wet second set of ingredients 60 are placed in the tube 12 at the filling end 25 and the end plunger 30 is inserted in such a way that all air in the tube 12 is bled off.

In some embodiments, the first set of ingredients 50 is placed in the tube 12 through the aperture in the dispensing end 15 defined by the threaded collar 18. In many embodiments, the first set of ingredients 50 will fill the bulk of the space in the first cavity 40, i.e. between the second plunger 35 and the dispensing end 15, but not completely. That is, when the tube 12 is in an upright position, there may be space between threaded collar 18 and the first set of ingredients 50. This space can be achieved by controlling the quantity of ingredients 50, 60 in the tube 12, or by altering the location of the first and second plungers 30, 35. A small space or gap allows space for a mixing apparatus (described below) to open, compensation for the volume of the mixing shaft which will enter the cavity, and slight expansion of the mixed ingredients, particularly those that impart non-shrinking characteristics of the resultant mixture in some implementations.

In another embodiment, in which the nipple 20 is pre-attached to the tube 12 (perhaps through integral forming of the nipple 20 and tube 12, the first set of ingredients 50 may be inserted into the tube 12 first through the filling end 25, and the second plunger 35 may then be put in place within the tube 12 before filling the tube 12 with the second set of ingredients 60 and closing the tube with the first plunger 30.

The filled dispensing device 10 can be stored "standing up" on its filling end 25, so long as the ingredients maintain their respective integrity.

Figure 3:
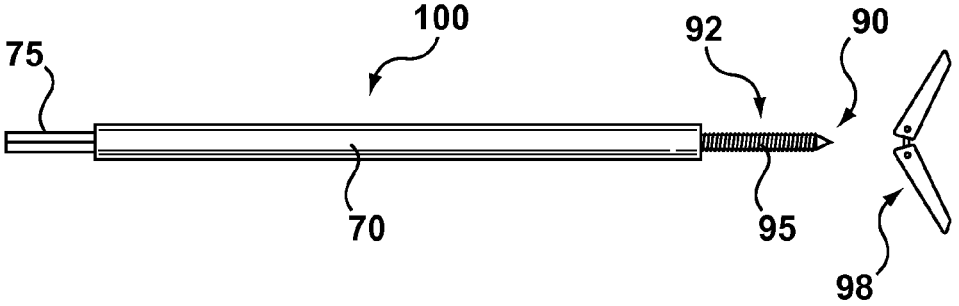
FIG. 3 shows an exploded view of an example embodiment of a mixing apparatus.

Reference is now made to FIG. 3, which illustrates an exploded side-view of one example embodiment of a mixing apparatus 100. The mixing apparatus 100 includes an elongate shaft 70. The shaft 70 features a first end 75 that may be keyed for use with a driving mechanism. For example, the first end 75 may be turned down to fit a hand-operated drill. The shaft 70 includes a second end 92 that narrows to a sharp point 90. The sharp point 90 is configured to pierce the membrane 36 (FIG. 1) of the second plunger 35. The second end 92 in this embodiment is turned down to a threaded shaft 95 onto which is threaded a spring-loaded toggle bolt 98 or the like. The toggle bolt 98 is threaded onto the second end 92 such that the wings of the toggle bolt 98 fold 'forward'; that is, towards the direction of insertion of the mixing apparatus 100 into the tube 12 (FIG. 1).

The illustrated embodiment features a rigid shaft 70; however, it is understood that a flexible shaft may be used in some embodiments, provided the shaft 70 is sufficiently rigid to exert the axial force required to pierce the membrane 36 using the sharp point 90 at the second end 92.

Figure 4:
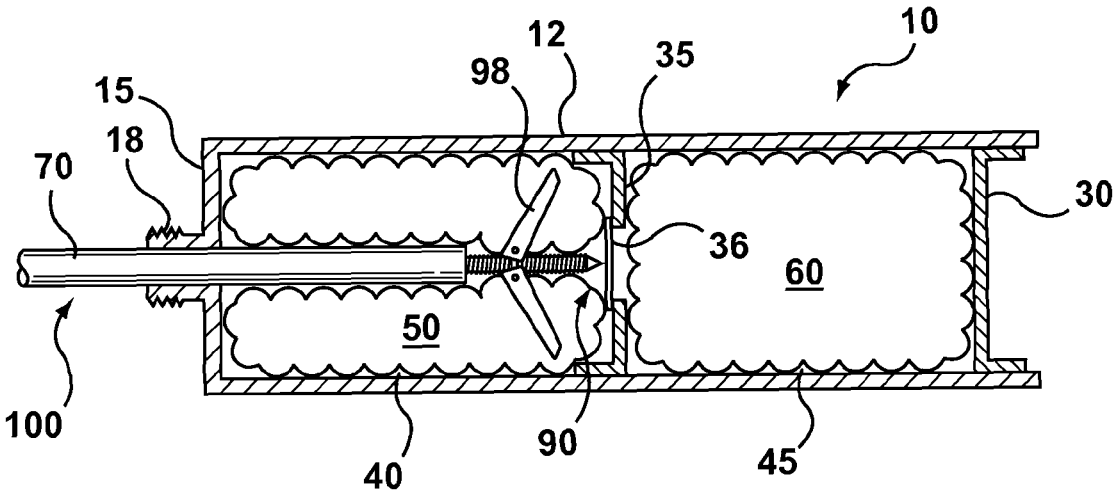
FIG. 4 shows an axial-section view of the dispensing device after initial insertion of the mixing apparatus into the tube.
Figure 5:
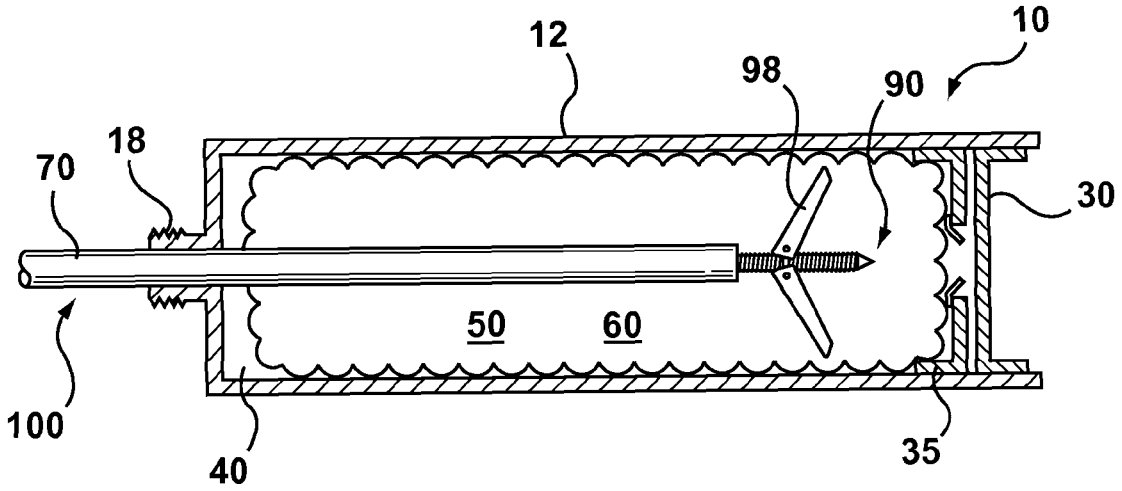
FIG. 5 shows an axial-section view of the dispensing device during a mixing stage.

Reference will now be made to FIGS. 4 and 5 to illustrate an example use of the mixing apparatus 100 with the dispensing device 10. FIG. 4 shows an axial-section view of the dispensing device 10 and mixing apparatus 100 after initial insertion of the mixing apparatus 100. FIG. 5 shows an axial-section view of the dispensing device 10 and mixing apparatus 100 during a mixing stage.

The nipple 20 (FIG. 1) in this embodiment is removed from the tube 12. In some embodiments, the tube 12 may be packaged and sold with or without the nipple 12. For example, a removable seal, such as a metal foil that may be pierced and/or peeled away, may be adhesively attached to the end of the collar 18. The nipple 20 may be sold separately or may be packaged with the tube 12.

The mixing apparatus 100 is inserted into the tube 12 through the collar 18. The insertion of the mixing apparatus 100 takes place with the wings of the toggle bolt 98 folded forward. The tube 12 may be held upright during the insertion process. Once inside the tube 12, the spring or other biasing mechanism in the toggle bolt 98 urges the wings outwards in its unfolded or expanded position. The small gap or space of air within the first cavity 40 allows for opening of the toggle bolt 98. The mixing apparatus 100 is then pushed further into the tube 12 passing into and through the first set of ingredients 50 until the sharp point 90 of the mixing apparatus 100 pierces the membrane 36 of the second plunger 35. The mixing apparatus 100 is then further urged into the tube 12, exerting pressure upon the second set of ingredients 60 and causing them to flow through the aperture 38 in the plunger 35. In effect, the first cavity 40 grows in size, while the second cavity 45 decreases in size. The second plunger 35 is pushed towards the first plunger 30, until it abuts the first plunger 30 or is otherwise stopped. At this point, the ingredients 50, 60 are combined in the same cavity 40, but are not evenly mixed.

To facilitate even mixing of the two ingredients 50, 60, the mixing apparatus 100 is withdrawn a short distance and a rotary driving mechanism, such as an electric drill, is then used to turn the mixing apparatus 100, causing the shaft 70 and toggle bolt 98 to rotate within the tube 12, thereby mixing the ingredients 50, 60. As the drill drives the rotating mixing shaft 70, the mixing apparatus 100 may be axially reciprocated, i.e. pulled back and forth through the mixture. In many embodiments, the diameter of the mixing shaft 70 is arranged to be only slightly less than the interior diameter of the collar 18. Accordingly, the mixture of ingredients is prevented from being sprayed out of the tube 12. Furthermore, the small amount of air space initially in the first cavity 40 allows for the frothing of the material, and for the added volume of the mixing shaft 70 as it is added to the total volume in the tube 12 during mixing.

In some embodiments, the toggle head 98 is shaped so as to contact the inside surface of the tube 12 while mixing. In one embodiment, the free ends of the wings of the toggle bolt 98 may be flared or twisted so as to act as vanes when the toggle bolt 98 is rotated.

When mixing is complete, the drill or other rotary driving mechanism stops and the mixing apparatus is extracted from the tube 12, and cleaned for re-use. Mixed material coating the shaft 70 is at least partly scraped off by the interior of the collar 18 as the shaft 70 is extracted. Moreover, the collar 18 causes the toggle bolt 18 to fold forward into its compact position during extraction. The mixed product is then ready to use. A nipple 20 may be attached to the collar 18 and the material dispensed from the tube 12 using a caulking gun or the like.

It will be appreciated that the foregoing mixing process includes inserting a mixing apparatus, piercing the membrane in the second plunger, pushing the second plunger towards the first plunger to cause the second set of ingredients to flow into the same cavity as the first set of ingredients, and then mixing the combined ingredients. Mixing may be accomplished using a variety of rotary mechanisms. In other embodiments, the mixing may include other mixing mechanisms such as, but not limited to, mechanical, electrical, electro-mechanical mechanisms and the like. For example, the mixing apparatus may employ ultrasound to mix the ingredients.

It will be appreciated that although the foregoing description refers to a first set of first ingredients and a second set of ingredients, the present application is not limited to sets containing more than one ingredient. In some embodiments, either the first set or second set of ingredients may have a single substance. In many embodiments, the first set and/or second set include a plurality of ingredients that are premixed before insertion into their respective cavities in the tube.

Examples of wet ingredients include, but are not limited to: i) various resins (such as, but not limited to acrylic resins); and ii) water. Other wet ingredients are known in the art.

Examples of dry ingredients include, but are not limited to: fillers commonly used in adhesives; grouts (including fumed silica, sand, lime, phenolic micro spheres, etc.), and petroleum fluid coke.

Example of a final mixture include lime-and-cement-based products (such as mortars). Another example includes dry cement in one compartment, and water with a pigment as the wet ingredient. The resulting mixture provides mortar for use. The pigment is chosen to provide custom colouring of the final mixture. Another example of a final product includes a non-shrink grout produced by dry ingredients that effervesce when mixed with water; the shrinking effect due to water evaporation is compensated by the presence of gas released during the effervescence and trapped in the final mixture.

Example mixtures are described in US provisional patent application 61/589,886, filed Jan. 24, 2012, and owned in common herewith. The contents of U.S. application 61/589,886 are hereby incorporated by reference.

In an example embodiment, one cavity of the tube is filled with a mixture of acrylic resin, microspheres, chalk and a thickener based on the acrylic resin. The other cavity is filled with petroleum fluid coke. A particular composition is: 90 gm chalk, 25 gm micro spheres, 290 gm acrylic resin and 60 gm thickener (in one space), and 220 gm of coke (in the other space). Variations of the thickness of the mixtures can be made by adjusting the ratios in the filling process.

In some cases, lime may be used in place of chalk. In yet other examples, a different inert small particle thickener may be used, such as diatomaceous earth, pyrogenic silica, or methylated silica.

In another embodiment, preparation of coloured cement can be achieved using an embodiment of the device of the present disclosure. The wet ingredient is water that is optionally dyed. The dry ingredient is cement mortar in one space and water that has been accurately dyed in the other. Alternatively, the wet ingredient is water, while the dry ingredient is a mixture of a dry chemical pigment and cement mortar. When ready to use, a worker skilled in the art mixes the ingredients, and uses the caulking gun to deposit the fresh cement mixture into mortar joints.

A specific embodiment may include an adhesive grout mixture according to the following formulation (by volume):

2 parts diatomaceous earth
2 parts microballoons
2 parts fluid coke
3 parts of an acrylic resin (for example, a mixture of 3 Rhoplex™ MC-76 to 1
Rhoplex™ LC-67)
¼ part water
Thickener as desired In this embodiment, the fluid coke is placed in either the first cavity or the second cavity and the remainder of the ingredients are placed in the other cavity. The fluid coke reacts with the water and other liquids to produce gases that give the final adhesive grout mixture its non-shrink characteristics.

In some other embodiments, the diatomaceous earth or other inert small particle thickener is pre-mixed with the fluid coke and placed in the first or second cavity, while the remaining ingredients are placed in the other cavity. If the inert small particle thickener is lime, it tends to flatten out over time when mixed with the thickener and other ingredients, thereby causing the mixture to lose its pseudo-plastic characteristics.

The dispensing device of the present application allows mixtures of this nature to be pre-packaged and stored for long periods of time before use, rather than requiring that the ingredients be combined and mixed in a bucket or other container on-site and then loaded into a bulk caulking gun for use.

It will be appreciated that different ratios of different acrylic resins and other ingredients may be used to produce final mixtures having desired elasticity and/or rigidity or other properties.

Certain adaptations and modifications of the described embodiments can be made. Therefore, the above discussed embodiments are considered to be illustrative and not restrictive.

What is claimed is:

1. A dispensing device for dispensing a mixture of ingredients, the dispensing device comprising:

a tube having a filling end and a closed dispensing end, the closed dispensing end including an aperture through which the mixture of ingredients is dispensed, in use;

a first plunger in the tube sealing the filling end;

a second plunger in the tube between the dispensing end and the first plunger, the second plunger including a breakable membrane portion; and a mixing apparatus, including an elongate shaft having a pointed end and a driving end, a foldable set of flanges configured to be attached to the pointed end of the shaft, and wherein a first cavity is defined between the dispensing end and the second plunger for holding a first ingredient, and wherein a second cavity is defined between the first plunger and the second plunger for holding a second ingredient, and wherein the foldable set of flanges has a width less than a diameter of the aperture when in a folded position, and wherein the foldable set of flanges is biased in an unfolded position, and wherein the pointed end of the shaft is configured to pierce the breakable membrane portion when the mixing apparatus is inserted into the tube through the aperture.

2. The dispensing device of claim 1, wherein the pointed end of the elongate shaft includes a threaded portion, and wherein the foldable set of flanges is configured to be attached to the pointed end by threading the foldable set of flanges onto the threaded portion.

3. The dispensing device of claim 2, wherein the foldable set of flanges comprises a toggle bolt.

4. The dispensing device of claim 1, wherein the driving end includes a keyed portion configured to be driven by a rotary driving mechanism.

5. The dispensing device of claim 4, wherein the keyed portion is configured to be driven by a hand-held drill.

6. The dispensing device of claim 1, wherein the breakable membrane portion includes an axial aperture defined in the second plunger and a membrane material sealing the axial aperture.

7. The dispensing device of claim 6, wherein the membrane material comprises a metal foil.

8. The dispensing device of claim 6, wherein the second plunger is configured to move from an initial position to a mixing position adjacent the first plunger under axial force from the mixing apparatus, and wherein the second cavity is compressed during movement from the initial position to the mixing position thereby causing the second ingredient to pass through the axial aperture to mix with the first ingredient in the first cavity.

9. The dispensing device of claim 1, wherein one of the first and second ingredients is a wet ingredient, and the other of the first and second ingredients is a dry ingredient.

10. The dispensing device of claim 9, wherein the wet ingredient includes water and at least one thickener, and wherein the dry ingredient includes fluid coke.

11. The dispensing device of claim 10, wherein the dry ingredient includes at least one of chalk, diatomaceous earth, methylated silica, or pyrogenic silica.

* * * * *